US006883839B2

(12) United States Patent
Belmond et al.

(10) Patent No.: US 6,883,839 B2
(45) Date of Patent: Apr. 26, 2005

(54) AUTOMOBILE VEHICLE LOCK

(75) Inventors: Jean Marc Belmond, St. Jean le Blanc (FR); Frédéric Burkat, Sully sur Loire (FR); Sylvain Chonavel, Sully sur Loire (FR); Yi Hwa Chu, Ouzouer sur Loire (FR); Pascal DeVries, Sandillon (FR)

(73) Assignee: ArvinMeritor Light Vehicle Systems - France (FR)

( * ) Notice: Subject to any disclaimer, the term of this patent is extended or adjusted under 35 U.S.C. 154(b) by 0 days.

(21) Appl. No.: 10/365,010

(22) Filed: Feb. 12, 2003

(65) Prior Publication Data

US 2003/0164616 A1 Sep. 4, 2003

(30) Foreign Application Priority Data

Feb. 12, 2002 (FR) ..... 02 01699

(51) Int. Cl.[7] ..... E05C 3/06
(52) U.S. Cl. ..... 292/201; 292/216
(58) Field of Search ..... 292/216, 203, 292/DIG. 23, DIG. 29

(56) References Cited

U.S. PATENT DOCUMENTS 4,872,714 A * 10/1989 Brusasco ..... 292/201
4,978,154 A * 12/1990 Kleefeldt et al. ..... 292/201
5,236,234 A * 8/1993 Norman ..... 292/201
5,454,608 A * 10/1995 Dzurko et al. ..... 292/216
5,992,194 A * 11/1999 Baukholt et al. ..... 70/279.1
6,003,910 A * 12/1999 Dupont et al. ..... 292/201
6,019,402 A * 2/2000 Arabia et al. ..... 292/216
6,053,543 A * 4/2000 Arabia et al. ..... 292/201
6,062,613 A * 5/2000 Jung et al. ..... 292/201
6,065,316 A * 5/2000 Sato et al. ..... 70/264
6,079,757 A * 6/2000 Aubry ..... 292/201

FOREIGN PATENT DOCUMENTS

| | | |
|---|---|---|
| DE | 19600524 | 6/1997 |
| EP | 0589158 | 3/1994 |
| EP | 0828049 | 3/1998 |
| WO | WO 01/66889 | 9/2001 |

OTHER PUBLICATIONS

French Search Report Dated Oct. 14, 2002.

* cited by examiner

*Primary Examiner*—Gary Estremsky
(74) *Attorney, Agent, or Firm*—Carlson, Gaskey & Olds

(57) ABSTRACT

An automobile vehicle lock is released under normal operating conditions by an electric motor. Under degraded conditions, a mechanical release of the lock is enabled. This allows the motor providing electrical release of the lock to be simply dimensioned for release under normal operating conditions with no requirement to over-dimension the motor to ensure the lock will open under degraded operating conditions. Because release of the lock is mechanical under degraded operating conditions, enablement of the mechanical release is provided by a low-power standby motor. This allows a compact and inexpensive standby power source to be employed.

15 Claims, 11 Drawing Sheets

AUTOMOBILE VEHICLE LOCK

This application claims priority to French Patent Application serial number 0201699 filed on Feb. 12, 2002.

BACKGROUND OF THE INVENTION

The present invention relates to automobile vehicle locks.

Locks mounted on a vehicle door are used to keep the automobile vehicle door in the closed position. Locks typically allow the door to be opened by operating either inside or external manipulators linked to the lock and able to be operated by a user. The locks include a claw mechanism designed to selectively set the position of cooperating means mounted on the vehicle with respect to the lock or release the cooperating means. Opening the lock involves disengagement of the claw from these cooperating means, allowing the door to be opened. Closing the lock involves keeping the cooperating means set with the claw in the lock, thus preventing the door from being opened. The claw mechanism is urged into its closing position by the cooperating means when the door is being closed. A pawl prevents the claw from returning to its release position, keeping the lock in the closed position, until the lock is subject to external action.

For purposes of this application, locking of the lock involves preventing the lock from being opened by using an external release control. Unlocking is the reverse operation, allowing the lock to again be opened when the external release control is manipulated. In the case of an automobile vehicle door, these operations are conventionally performed using a fascia pull or electromechanical actuator. In the case of a hatchback door or trunk (both doors for purposes of this application), an interlocking device is also used for locking or unlocking purposes.

For purposes of this application, "security locking" involves preventing the lock from being opened by operating an inside release control when the door is locked. Security locking notably prevents a vehicle door from being opened using the inside release control after the window glass has been broken. "Security locking release" is the reverse operation, consisting in again allowing the lock to be opened by operating the inside release control. In the case of an automobile vehicle door, these operations are conventionally performed using a specific electromechanical actuator. Examples can be found in the Peugeot 406, year 2000 model, or the Audi A4, again year 2000 model, which use locks of this type. A child-proof feature prevents the lock from being opened from the inside regardless of whether it is locked or not. As known, this feature prevents a vehicle door from being accidentally opened from inside, to protect children and is frequently provided on the rear doors of vehicles. For a vehicle rear door, these operations are conventionally performed using a key cylinder or electromechanical actuator. The Volkswagen Golf, year 2000 model, or the Renault Laguna II, year 2000 model, adopts such a solution.

An override feature allows the lock to be opened and simultaneously, locking to be released, or, with the child-proof catch set, the lock to be unlocked by operating the inside release control. This feature allows a door lock to be released in the case of accident allowing a passenger in the rear of a vehicle with the child-proof feature set, to unlock the lock, allowing the door to be opened from the outside.

Mechanical and electromechanical locks exist, which implement one or several of the above features.

European Patent Application 0,694,644 discloses an automobile vehicle lock with electrical release. The lock is released electrically by operating an actuator powered by the vehicle battery. A backup energy supply is provided by a back-up battery installed in the vehicle door where the lock is installed. Should the electrical supply from the vehicle battery be defective, the lock can still be opened using the electrical power supplied by the back-up battery.

This solution does raise a problem in dimensioning the door lock release motor. The motor should not only allow the lock to be opened under normal conditions of use but also under degraded conditions, for example after impact. The ratio between the force needed under degraded conditions and the force needed under normal operating conditions may be of on the order of 3:1. As and example the force may typically change from 300 N to some 1000 N. The motor and its speed reduction gear are consequently designed to ensure release under degraded conditions which leads to electrical and mechanical over-dimensioning of the motor with respect to normal use requirements. Motor dimensioning also creates a problem for the back-up power supply. The back-up power supply needs to be capable of supplying sufficient energy to ensure release under high loads.

The lock used in the Renault Laguna II has a claw mechanism operated by an assembly consisting of a pawl and pawl lifter referred to hereunder as a pawl assembly. The lock has separate inside and external release levers. A release coupling lever is inserted between a bearing surface on the external release lever and a bearing surface on the pawl assembly. When the release coupling lever is in position between the bearing surface on the external release lever and the bearing surface on the pawl assembly, rotation of the external release lever causes the pawl to rotate and the lock to open. When the release coupling lever is not in position between these bearing surfaces, turning the external release lever has no effect on the pawl, and the lock is locked. A second release coupling lever is inserted between a bearing surface on the inside release lever and a second lever which is engaged with the pawl assembly. The second release coupling lever operates similarly to the first one, withdrawing it ensuring security locking or activation of the child-proof feature. Insertion releases security locking or deactivates the child-proof feature. Override is ensured when the security locking feature has been released via a cam controlled by the inside release lever. Displacement of the cam causes the first release coupling lever to become inserted between the bearing surfaces on the external release lever and the pawl.

When the lock is motor driven, the first release coupling lever is operated by a first motor for locking or unlocking the lock. The displacement of the first release coupling lever is also controlled mechanically and by an interlocking device. The motor has no back-up power supply. A safety button on the edge of a door makes it possible, in the case of an electrical failure or flat battery, to lock the lock, and then close the door in order to abandon the vehicle with the door locked. A second motor operates the second release coupling lever allowing security locking, or release of security locking or activation or release of the child-proof feature.

In this lock, only locking, unlocking, security locking, release of security locking and activation or deactivation of the child-proof feature are provided by electric motors. Release remains otherwise purely mechanical.

European Patent Application 0,589,158 discloses a lock in FIG. 2 with an electrical release actuator that operates on a pawl. The actuator is triggered by contacts provided on external and inside release controls. A rotary lever has a rest position and an active position. The electric release actuator allows the rotary lever to be brought from a rest position to the active position. The rotary lever is mechanically connected by cables to the external and inside release controls. In the rest position, the rotary lever does not act on the pawl. In the active position, the rotary lever is adapted to act on the pawl when it is driven mechanically through the inside and external release controls. A back-up power supply powers the actuator should the vehicle battery fail. The lock is thus an electrically-opened lock when the electric release actuator does not act on the pawl. In such situations, mechanical release using the rotary lever is declutched. In the case of a collision or failure of the vehicle battery, the electric operating actuator acts on the rotary lever to bring it to its active position, and the lock is opened mechanically.

This solution has some disadvantages. As an example, should the electric release actuator fail, the lock cannot be opened either electrically, or mechanically. The same applies when the electrical wiring to the door is cut so that the actuator is no longer connected to the vehicle battery, nor to the standby battery. The danger of self-release is managed by electronic redundancy based on speed information. However, this solution may prove insufficient when parking on a slope.

European Patent Application 0,598,158 further discloses a movable, spring-biased electrical release actuator body. A cable system allows the electrical release actuator body to be moved axially in order to operate on the pawl from the external release control and inside release control. Thus, even in the presence of electrical failure, it is possible to release the lock mechanically and shift the actuator body. The cable system is only operated when the displacement travel of the external release control or the inside release control is greater than the length of travel required to trigger the sensors that control electrical release. In this embodiment, the lock is an electrically and mechanically opened lock. Neither electrical release nor mechanical release can be selectively coupled.

The European Patent Application 0,598,158 does not discuss how the locking, security locking, child-proof feature or override functions are implemented. As mechanical release is always enabled, action that is too fast or too violent on the release controls leads to simultaneous electric and mechanical release, which can damage the electric release actuator.

European Patent Application 0,828,049 discloses a lock with a coupling member mechanically driven by cables connected to inside and external release controls. The coupling member is rotatively mounted on the same axis as the pawl. A coupling slide member can move in translation between a coupling position and a retracted position. In the coupling position, the coupling slide member transmits rotation of the coupling member to the pawl. In a retracted position, rotation of the coupling member has no effect on the pawl. In this way, the lock ensures locking, child-proofness and security locking. An auxiliary electric drive is used for driving the coupling member or the pawl. The auxiliary electric drive is controlled on the beginning of travel of the release control.

The above described solutions have some disadvantages. As an example, if the auxiliary electric drive drives the coupling member, the lock is an electrically-assisted mechanically released lock. Action that is too rapid or too violent on the release control will lead to simultaneous electrical and mechanical release. The simultaneous release may damage the auxiliary electric drive. If the auxiliary electric drive is blocked, the lock can no longer be opened, electrically or mechanically.

The assumption where the auxiliary electric drive is responsible for driving the pawl is not disclosed in detail. With this assumption, if the auxiliary electric drive becomes blocked, the lock can no longer be opened, electrically or mechanically.

International Application WO-A-01/66889 discloses a lock having an electric motor, which is designed to rotatively drive an eccentric stop member via a coupling. The coupling can be selectively coupled by means of a release coupling lever so that the motor drives the eccentric stop member. When the selective coupling is not engaged, the motor does not drive the eccentric stop member. The eccentric stop member acts on a positioning lever that acts on the pawl. The coupling lever is driven by an inner operating lever and by an external operating lever, respectively driven by the external release control and inside release control. In normal operation, the lock opens electrically when the coupling is established by operating either of the release controls, the corresponding operating lever and the coupling lever. A safety release feature, not described in detail, allows direct action of the inside or external operating lever on the pawl, through supplementary travel of the release controls.

SUMMARY OF THE INVENTION

There is a need for an electric lock, providing, partially or completely, locking, unlocking, security locking, release of security locking, activation/deactivation of a child-proof feature, and override in both normal and degraded conditions. Such a lock should be as resistant as possible to various types of failure.

In one embodiment, the invention therefore provides a lock for a door or the like. The lock being adapted to be released from the inside of the door by mechanical means. The mechanical means are adapted to be enabled for allowing release of the lock from the inside and disabled for preventing release of the door form the inside.

Preferably, the mechanical means are adapted to be mechanically enabled and disabled. The lock may further comprise an actuator that causes electrical release of the lock. The actuator may be an electric motor of an electric power less than 100 W, or even less than 80 W. The lock may further include a coupling mechanism having an enabled position and a disabled position and a lever operation of which brings about release of the lock when the coupling mechanism is in the enabled position.

The lock may further have a coupling mechanism for enabling the mechanical release. The mechanism includes an actuator that causes the mechanism to change over from the enabled position of the mechanical release to the disabled position of the mechanical release. The coupling mechanism actuator may be an electric motor of electric power less than or equal to 10 W.

In another embodiment of the invention, a module for a door includes a lock adapted to be released by electric means from the outside of the door. The lock is released from the inside of the door by a mechanical means. The lock includes a mechanical linkage connected at one end to the lock. The mechanical means is adapted to be enabled for allowing release of the lock from the inside and disabled for preventing release of the door from the inside.

The module may also include a release control linked to the other end of the mechanical linkage. A switch may be provided that represents the status of the release control.

In yet another embodiment, a vehicle includes a door provided with a lock adapted to be released by electric means from the outside of the door and being further adapted to be released from the inside of the door by a mechanical means. The mechanical means is adapted to be enabled for allowing release of the lock from the inside and disabled for preventing release of the door from the inside.

The lock has an actuator operation that provides electrical release of the lock. The actuator is of a power adapted to overcome the reaction force exerted by seals of the door under normal operating conditions.

Other features and advantages of the invention will become more clear from the description that follows given by way of example and with reference to the attached drawings.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF PREFERRED EMBODIMENTS

Figure 1:
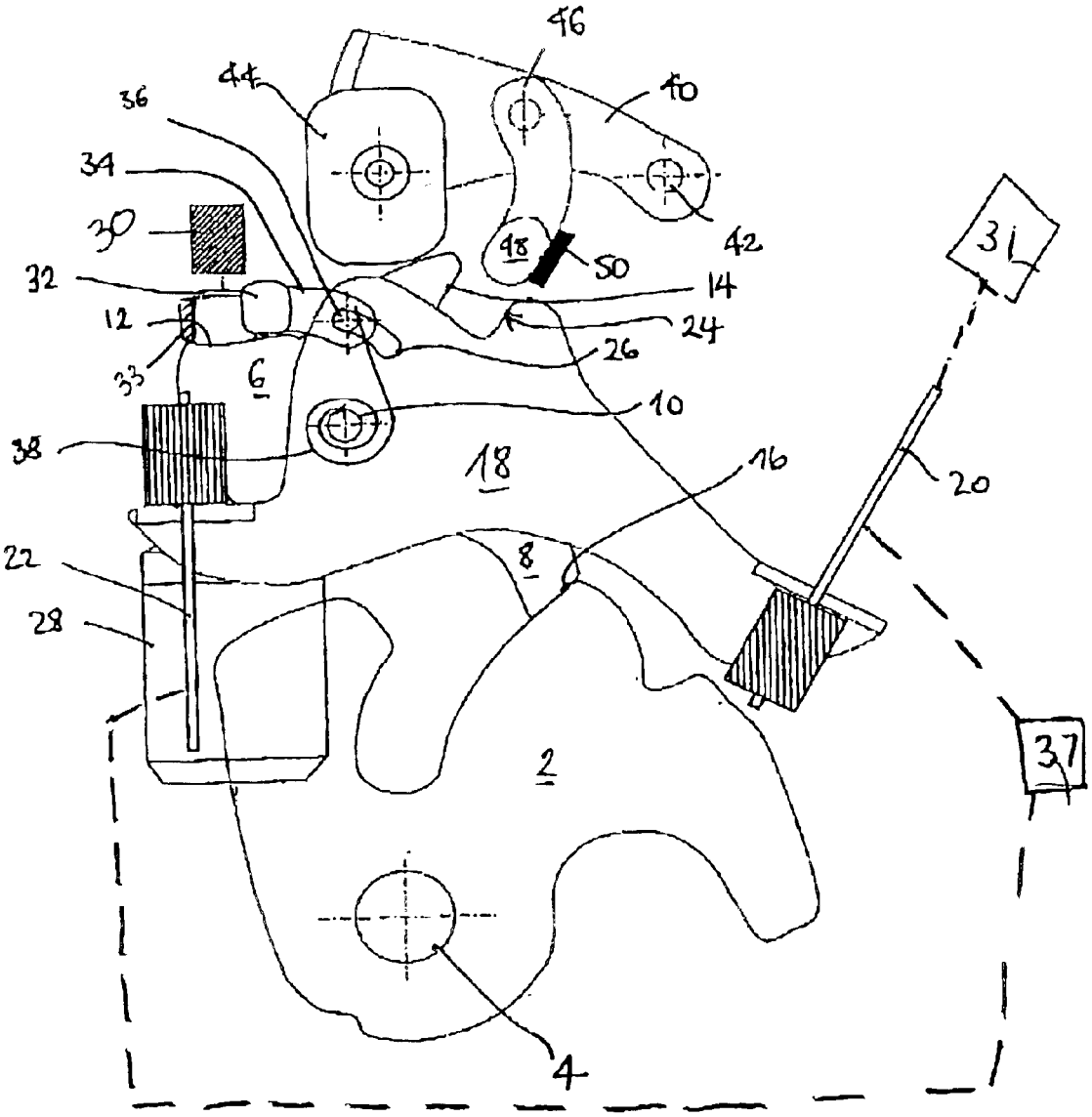
FIG. 1 is a diagrammatic view of a lock according to one embodiment of the invention, in a fully closed and locked position.

The invention provides a lock with an electric release as well as a selectively enabled mechanical release.

If the mechanical release is not selectively enabled into operation under normal conditions of use, the lock behaves like a purely electric lock. Consequently, the lock has the advantages of such a purely electric lock, notably as regards simplification of managing the various functions of authorizing or impeding release, discussed above.

The lock has a selectively enabled mechanical release, able to be used under degraded operating conditions. This means that it is not necessary for the electric motor that opens the lock to be dimensioned suitably to ensure release under degraded conditions. Thus, it is sufficient to dimension the motor to ensure release under normal conditions. The invention consequently makes it possible to employ a motor that is less powerful than those used in purely electrical state-of-the-art solutions.

In the following description, the terms vertical, horizontal, left, right, top and bottom to refer to the position of the lock shown in the drawings. These position descriptions are for illustrative purposes and should not be understood as limiting the position of the lock in operation.

Figure 4:
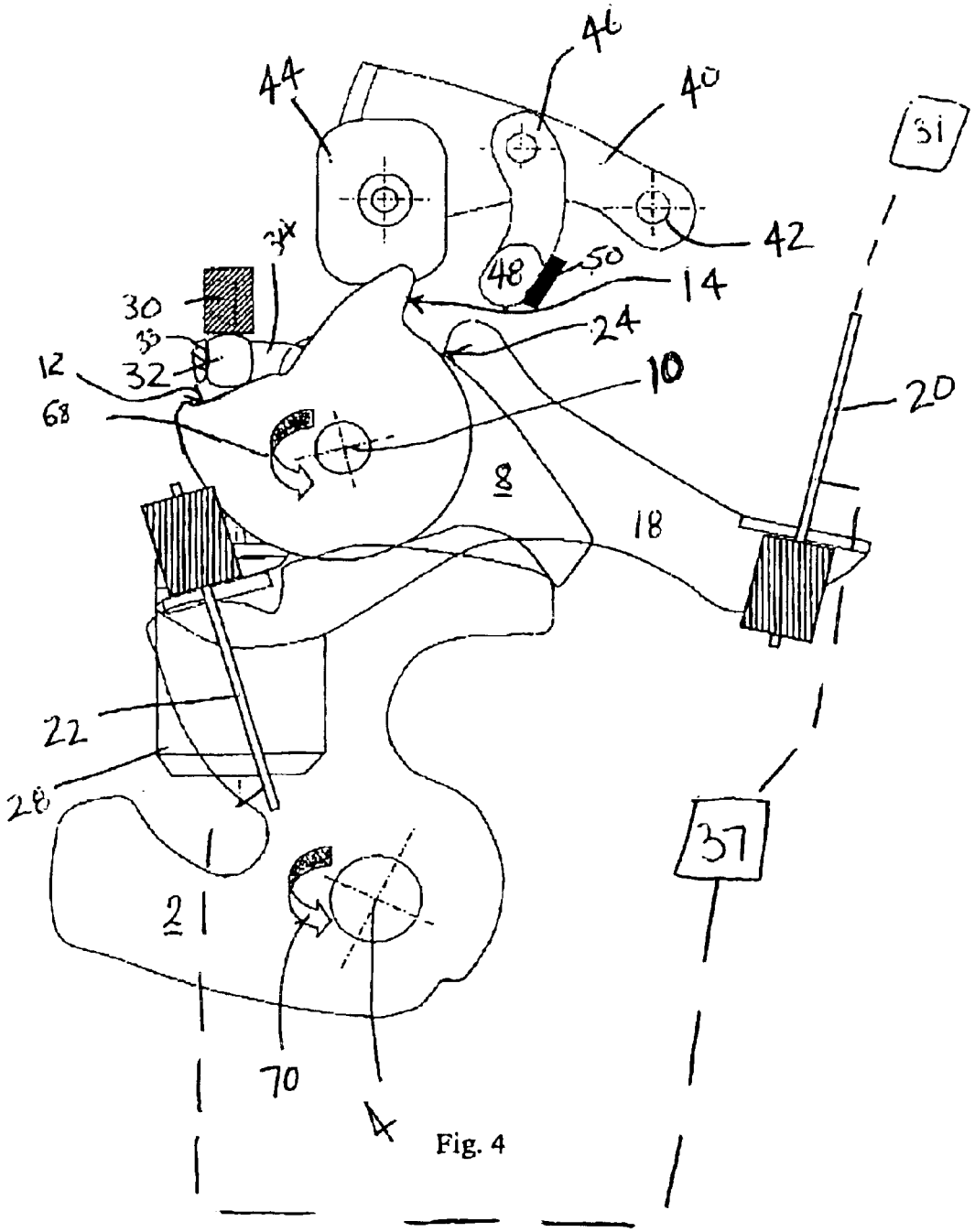
Figure 6:
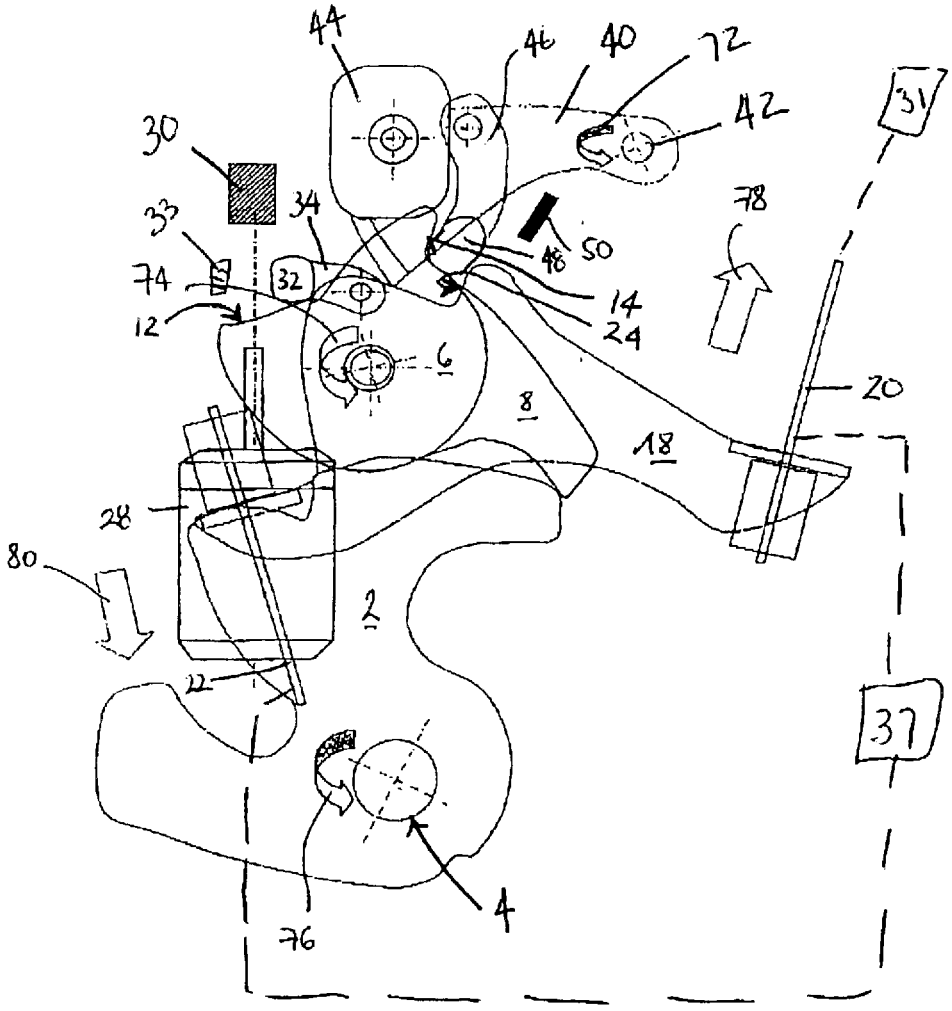

FIG. 1 is a diagrammatic view of a lock according to an embodiment of the invention, in a closed and locked position. FIG. 1 shows the claw 2 that is mounted rotatively about axis 4. Rotation of claw 2 about axis 4 in a counter-clockwise direction allows the door to be opened as shown in FIG. 4 or 6. The claw is biased by a spring clockwise, towards its open position.

In the position of the claw 2 shown in FIG. 1, a pawl 8 prevents the door release and keeps the claw 2 on cooperating means, not illustrated. The exact shape of the claw 2 and its movement are known and will not be described in more detail. The claw 2 can additionally be modified without this having a bearing on operation of the lock.

FIG. 1 further shows a pawl lifter 6 and the pawl 8. The pawl 8 and pawl lifter 6 can rotate about an axis 10. The pawl 8 and pawl lifter 6 can be better seen in FIGS. 3 and 4. The pawl 8 and pawl lifter 6 are of integral construction. Integral construction of the pawl 8 and pawl lifter 6 is advantageous for meeting assembly constraints. Counter-clockwise rotation of the pawl lifter 6 and the pawl 8 about axis 10 allows claw 2 to rotate counter-clockwise, consequently opening the lock.

Figure 3:
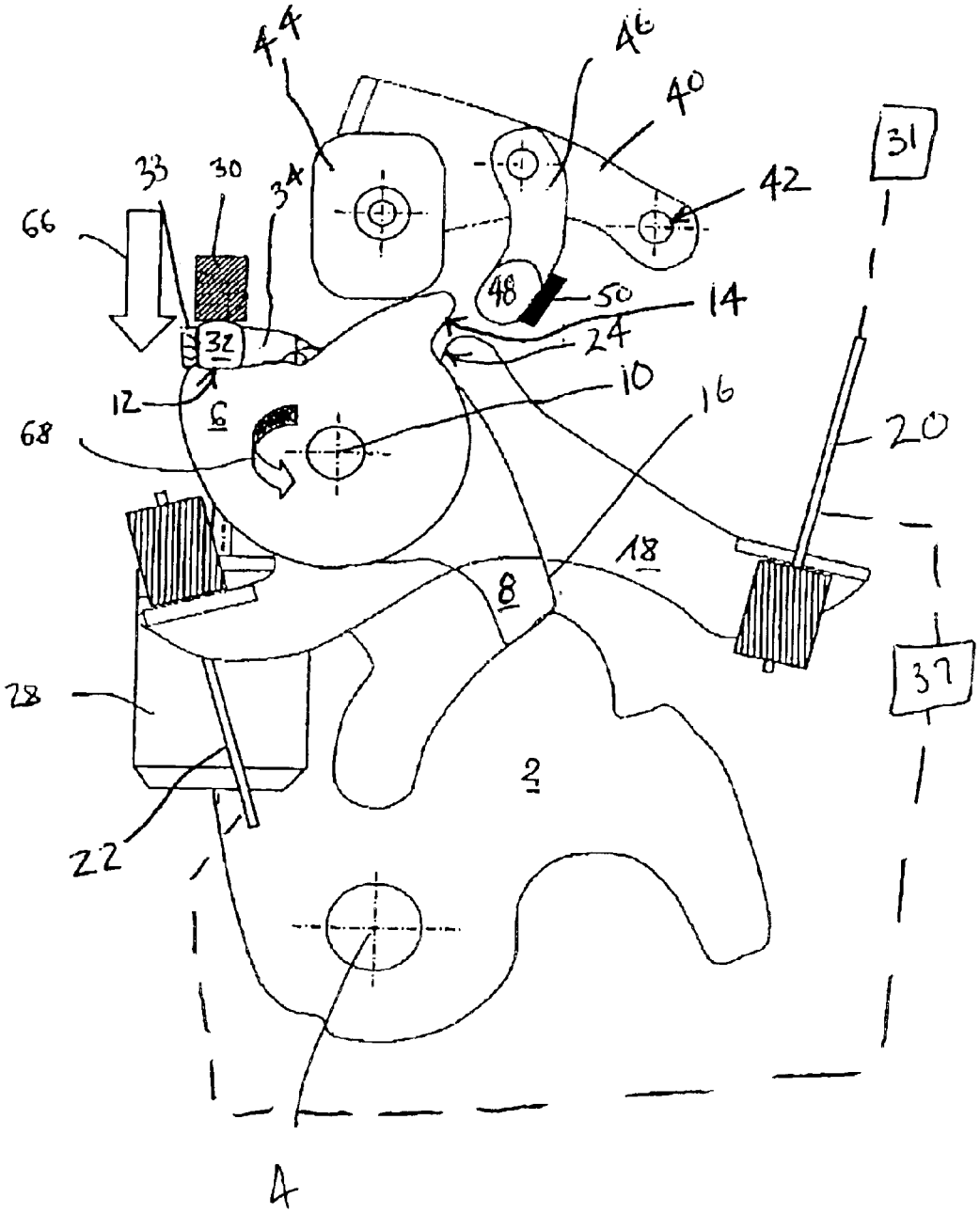

As best seen in FIG. 3, where the pawl 8 and pawl lifter 6 are in the foreground, pawl lifter 6 has a substantially circular shape, with a first bearing surface 12 and a second bearing surface 14. Abutment against either one of the bearing surfaces 12,14 causes the pawl 8 to turn counter-clockwise. Pawl 8 is integral with pawl lifter 6 so as to be driven rotatively by the pawl lifter 6 when the latter turns counter-clockwise. Pawl 8 has a finger portion 16 that comes into contact with the claw 2 preventing the latter moving when the lock is closed and locked, in the position shown in FIG. 1. Movement of finger portion 16 allows the claw 2 to rotate, as shown in FIG. 4 or 6. The pawl 8 and pawl lifter 6 are biased by a spring, not illustrated, towards the closed and locked position shown in FIG. 1.

A lever 18 for manually or mechanical opening the door (visible in FIG. 2) is rotatively mounted about axis 10 of the pawl lifter 6. The lever 18 is connected by an external release cable or rod mechanism 20, to an external release control not shown. The lever 18 is also connected by means of an inside release cable or rod mechanism 22 to an inside release control, again not shown. Operating the external release control or, respectively, inside operating control brings about, via cable 20 or, respectively, cable 22, rotation of lever 18 about the axis 10, in an counter-clockwise direction. Lever 18 also has a bearing surface 24 for driving pawl lifter 6 when mechanical release of the lock is selectively engage, as explained below with reference to FIGS. 5 and 6. Lever 18 further has an opening 26 the purpose of which is indicated below. A spring, not shown, biases lever 18 counter-clockwise to the closing position shown in FIG. 1.

A motor 28 for electrically opening the lock can be seen in FIG. 1. Motor 28 drives a drive arm 30 in translation along a vertical axis in FIG. 1. The motor 28 is electrically powered from the main electrical circuit of the vehicle and is dimensioned to ensure release of the door lock under normal operating conditions. The motor 28 typically consists of a DC motor of a power of 40 watts (for a reaction of seals etc. under normal conditions) with a no-load speed of the order of 12,500 rpm.

The lock has a release coupling lever 32, allowing release. Release coupling lever 32 is mounted at an end of an arm 34. The other end of the arm 34 carries a lug 36 that engages in the opening 26 of the lever 18. A spring 38 biases arm 34 to the left in FIG. 1. In the locked position shown in FIG. 1, when lever 18 is in the rest position, lug 36 bears against the left-hand end of opening 26 under the biasing action of spring 38. The arm 34 and release coupling lever 32 are then brought back towards the right by the lever 18 to clear the first bearing surface 12 of the pawl and drive arm 30.

In this position, powering of motor 28 and movement of drive arm 30 does not allow the pawl 8 to turn. The release coupling lever 32 consequently provides security against accidental release should motor 28 be accidentally powered.

When the inner or external release control is operated, lever 18 rotates about axis 10 counter-clockwise as shown in FIG. 3. In this position, spring 38 biases arm 34 to the left, and release coupling lever 32 adopts a position between first bearing surface 12 of pawl lifter 6 and drive arm 30. In this position, as explained below, the release coupling lever 32 enables motor 28 to be powered by closing a first contact schematically shown at 33. The release coupling lever 32 positioned between drive arm 30 and the first bearing surface 12 of the pawl 8 allows the door to be opened by powering motor 28.

Should motor 28 not operate correctly and if drive arm 30 moves towards first bearing surface 12 of the pawl lifter 6 and gets jammed in this position, the opening 26 in the lever 18 nevertheless allows the lever 18 to turn. In fact, if lever 18 turns, release coupling lever 32 comes into contact with the drive arm 30 and its movement becomes blocked. The lever 18 can continue to turn with the lug 36 moving inside opening 26 against the bias of spring 38. Opening 26, spring 38 and lug 36 consequently provide a safety measure against faulty operation of motor 28. This flexible linkage between the release coupling lever 32 and the lever 18 for manually opening the door prevents the lock jamming should the motor 28 fail when the drive arm 30 is in the lower position.

Finally, the cylindrical or rounded shape of the release coupling lever 32 facilitates its release under the effect of lever 18 recall spring 38 if the drive arm 30 get jammed in the position shown in FIG. 3 or 4. Releasing the release coupling lever 32 avoids, in this case, the lock getting jammed in an open position.

FIG. 1 shows elements of a selective coupling mechanism for mechanically opening the lock. This mechanism comprises an arm 40, which is rotatively mounted about an axis 42. Movement of arm 40 about the axis 42 is controlled by a standby motor 44 operating under very low load. The motor 44 allows arm 40 to turn in one direction or the other, for reasons explained below. A selective mechanical coupling finger 46 is mounted on arm 40. When standby motor 44 causes arm 40 to rotate counter-clockwise, an end 48 of mechanical coupling finger 46 is inserted between bearing surface 24 of lever 18 and the second bearing surface 14 of the pawl lifter 6. Reference numeral 50 shows a member for guiding the end 48 of mechanical coupling finger 46. Mechanical coupling finger 46 is rotatively mounted on arm 40, whereby its end 48 can turn about the axis 42 at the same time as the lever 18 and pawl lifter 6.

The following electrical contacts are provided for operating the lock. A second contact 31 is provided at the external release control and is operated when the user manipulates this control. As explained above, the first contact 33 is operated by release coupling lever 32 enabling release, when it becomes inserted between drive arm 30 and the first bearing surface 12 of the pawl 8. A "door open" contact schematically shown at 37 has two states representative of the open or closed state of the door.

Figure 2:
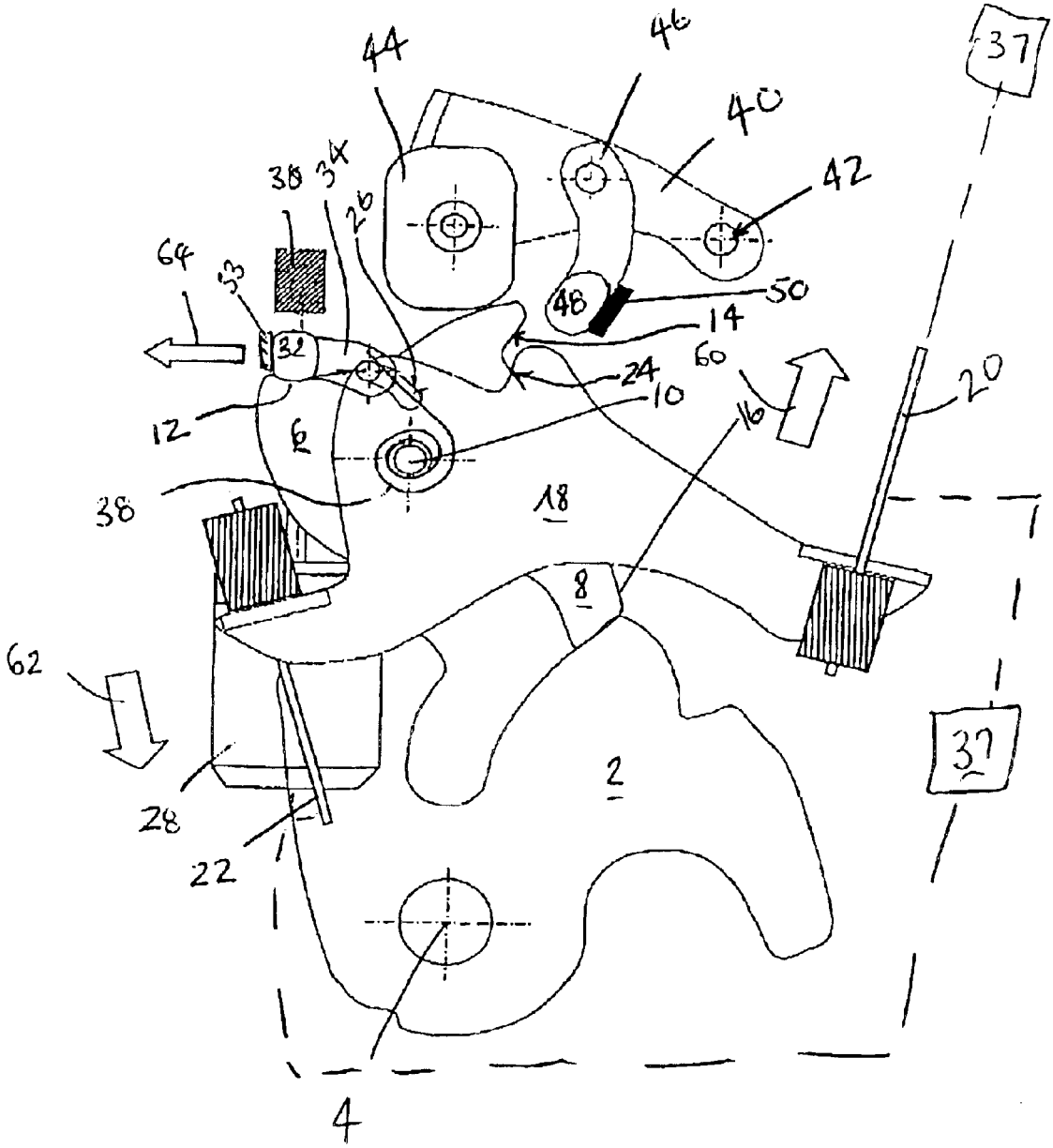
FIGS. 2–4, which show the lock of FIG. 1, show how the various parts of the lock move during electrical release of the lock in normal operation.

Under normal conditions, operation of the lock is as shown in FIGS. 2 to 4. FIG. 2 shows how the lever 18 moves if the external release control is operated. The cable or rod mechanism 20 transmits this manipulation of the release control to the lever 18 that turns about the axis 10, as shown by arrow 60. Under the effect of rotation of lever 18, the release coupling lever 32 is driven to the left in FIG. 2, as shown by arrow 64. The release coupling lever 32 becomes positioned between drive arm 30 and the second bearing surface 12 of the pawl lifter 6. At the end of travel, the release coupling lever 32 operates the first contact 33.

It will simply be noted that under normal operating conditions, the loading on the linkages between lever 18 and the inside and external release controls is low in value. The linkages are simply required to transmit that force necessary for driving lever 18 in rotation against the biasing spring force recalling lever 18 to its position shown in FIG. 1. This force can be of the order of 10 to 20 N. Under normal operating conditions, the mechanical coupling finger 46 does not interact with the lever 18 meaning that rotation of the latter has no effect on the pawl lifter 6. It is consequently not necessary, at this stage, for the linkages to be of strong construction, in view of the small force requiring to be applied. This allows low strength linkages systems such as, for example, simple Bowden cables following tortuous paths to be employed. Additionally, cables that are longer than the distance between the lock and the controls can be employed. This feature has the advantage of uniformizing the lock and the linkage system, for various models of vehicle door. This also has the advantage of removing design constraints applying to the door. The distance between the lock and the controls used to release the lock no longer constitutes a parameter limiting door design.

It will also be noted that the linkage between the lever 18 and the inside and external opening controls is actuated at each attempt to release the lock. This feature ensures that the linkages operate regularly, avoiding malfunction which could result from an extended period of non-use.

FIG. 3 shows the movement of the drive arm 30 under the action of motor 28. On FIG. 3, to clarify the description, lever 18 is shown behind the pawl 8 and pawl lifter 6. Operation of the first contact 33 by release coupling lever 32 energizes the motor 28, which drives the drive arm 30 towards release coupling lever 32 and the first bearing surface 12 of the pawl lifter 6, as illustrated by arrow 66. Under the effect of the drive force of motor 28, transmitted by the drive arm 30 and release coupling lever 32, the pawl 8 and pawl lifter 6 are driven counter-clockwise in rotation about the axis 10. This rotary movement is shown by arrow 68 on FIG. 3.

FIG. 4 shows the end of the lock release movement. The pawl 8 and pawl lifter 6 turn as shown symbolically by arrow 68, and allow claw 2 to turn. Under the effect of the reaction force of the seal, to which the vehicle door is subject, the latter turns counter-clockwise, as shown symbolically by arrow 70, and releases the closing cooperating means mounted on the vehicle to open the door.

Once the door has opened, the "door open" contact 37 changes state. The motor 28 is controlled to bring the drive arm 30 back to a raised position. The release coupling lever 32 is released and lever 18 returns to the position of FIG. 1 when the external release control ceases to be applied. The pawl 8 is biased back to the position of FIG. 1, so that closing the door brings the claw 2 and pawl 8 back to the position shown in FIG. 1.

The second contact 31 arranged in the external opening control triggers user identification, where the lock is contact-free. The position of the second contact 31 in the external release control also makes it possible to initiate identification when this control is operated. This represents a time-saving in identification corresponding to the time for mechanical transmission of control movement from the external control to release coupling lever 32 compared to a solution in which user identification is initiated by the first contact 33.

Lock release can be controlled from the inside release control, without providing this control with contacts. The first contact 33 established by release coupling lever 32 is sufficient to control motor 28. As explained below, providing one of the two release controls with contacts makes it possible to determine which of the two controls has brought about rotation of lever 18. This information concerning which control caused rotation of the lever 18 is useful for many purposes, for example, to initiate an override function.

As explained above, the motor 28 for electrical release of the lock is simply dimensioned to allow lock release under normal operating conditions. As stated above, it is sufficient for the motor 28 to have an electric power of the order of 40 watts, for a normal seal reaction force of 300 N. More generally, electric power of less than 80 or even 100 W for seal reaction forces higher than normal operating conditions is all that is required. By way of comparison, the motor of a purely electric lock such as that disclosed in European patent application 0,694,664 required electric power on the order of 170 watts to ensure the lock will be released even under degraded conditions.

The seal reaction referred to here is the force the seals exercise on the door or the like, opposing its closing. It is measured at the member, mentioned above, that co-operates with the claw 2 and corresponds to the force the lock exercises on this co-operating member to keep the door in the closed position. This reaction is typically from 300 to 700 N depending on the vehicle, under normal operating conditions. For purposes of this application, "normal operating conditions" are defined as a state of the vehicle (or more exactly, of the door or the like and its surround) in the absence of any deterioration and corresponding to nominal conditions specified for the vehicle. Degradation with respect to these normal operating conditions is the result of the door or the like or the vehicle itself, becoming deformed, for example as a result of impact. In this case, seal reaction force is typically three times greater than the nominal value, and we should consider values of 1000 to 2100 N. One could thus characterize normal operating conditions as corresponding to a seal reaction force less than 700 N. Motor power is chosen as a function of this seal reaction force. As indicated above, electric power can vary over a range of from 40 to 80 or even 100 watts when seal reaction force varies in the range of from 300 to 700 N. Power is adapted to normal seal reaction force and is preferably calculated for a seal reaction force slightly greater than the nominal force, for example 10 to 20 per cent above the normal force. Thus, it is not necessary to employ a 100 watt motor for a seal reaction force of 300 N.

Figure 5:
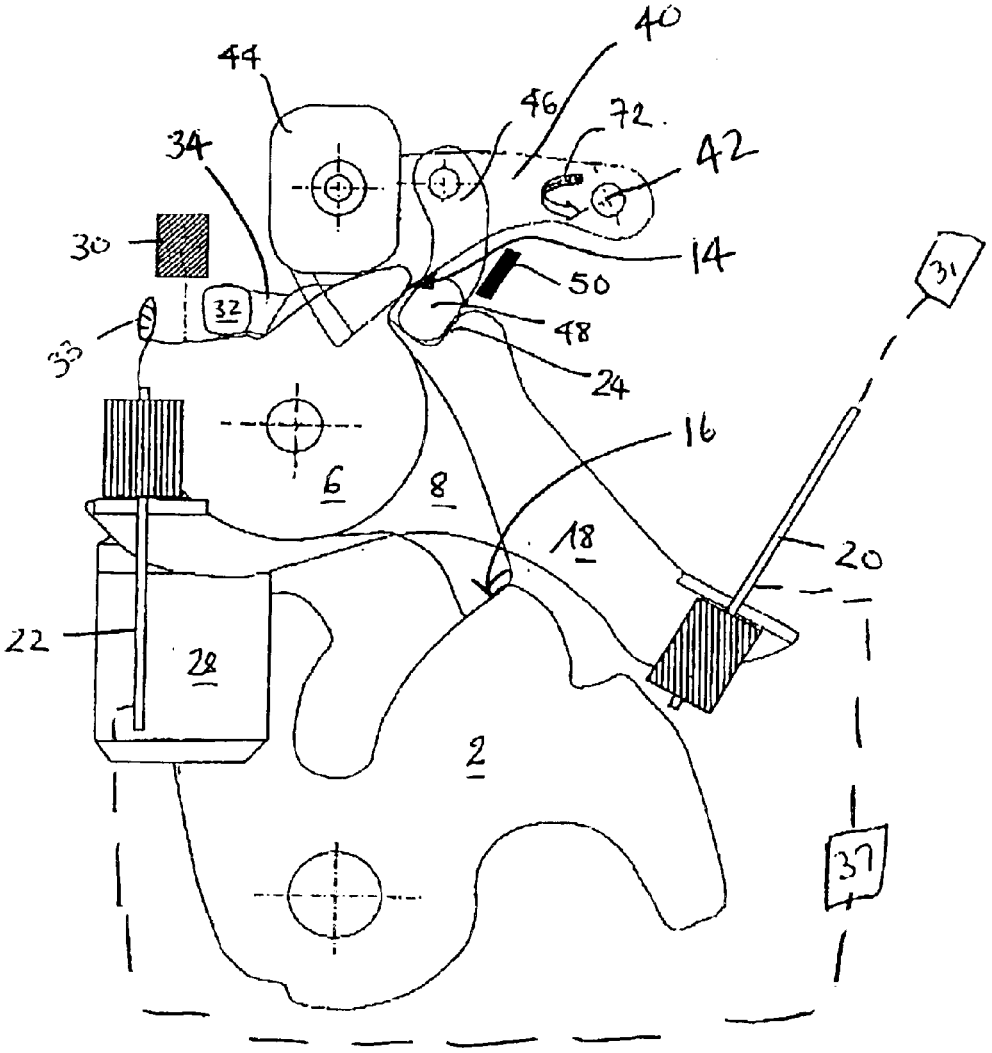
FIGS. 5 and 6 show the lock of FIG. 1 showing how the various parts of the lock move during mechanical release of the lock under degraded operating conditions.

FIGS. 5 and 6 are different views of the lock in FIG. 1, showing how the various parts of the lock move during mechanical release. Mechanical release is typically employed under degraded operation, if there is failure of one of the parts providing electrical release, if the vehicle electricity supply is cut off, or in the case of impact increasing the force needed for release to a value in excess of that which motor 28 can provide.

FIG. 5 is a view of the lock after powering standby motor 44 in order to selectively enable coupling for mechanically opening the lock. Referring to FIG. 5, operating the standby motor 44 causes arm 40 to rotate about axis 42 in an counter-clockwise sense as shown symbolically by arrow 72. As a result of this rotation, the mechanical release coupling lever 32 moves towards lever 18 and pawl lifter 6. The presence of guide member 50 helps ensure the end 48 of the finger gets inserted between bearing surface 24 of lever 18 and the second bearing surface 14 of the pawl lifter 6. In the position of FIG. 5, mechanical release is enabled, so that operating the inner or external release control causes the lock to open, independently of motor 28, as explained with reference to FIG. 6.

It will be understood that motor 44 is simply dimensioned to allow rotation of arm 40 and movement of the mechanical coupling finger 46. The motor 44 can therefore be dimensioned for low loads. Typically, a 10 W DC motor can be used for the motor 44 with a no-load speed of the order of 4000 to 6000 rpm. "Power" herein is the simple product of nominal voltage and the start-up current of the motor. This value is not representative of the mean power consumed by the motor (the energy consumed by the motor while arm 40 is rotating divided by the duration of this rotation). In practice, the average power consumed by the motor 44 is of the order of 1 W. As the motor 44 is of the low-power type and is only subject to a low load, a compact and inexpensive back-up power supply can be provided. A single cell, a battery, a super-capacitor or similar device for supplying a voltage of the order of up to 6 V can be employed. This standby power supply can be housed in the vehicle door. It will again be understood that setting up coupling for mechanical release simply requires standby motor 44 to drive arm 40 for rotation in the direction of arrow 72. A unidirectional motor would consequently suffice for coupling mechanical release. The arm 40 is biased back by a spring into the position where mechanical release is disabled. It is nevertheless advantageous to provide a bi-directional standby motor 44, with arm 40 not being biased by a recall spring. This ensures that should the standby power supply fail, arm 40 will remain in the position it was in and will not necessarily be brought back to the position where mechanical release is not enabled shown in FIG. 1. One can notably arrange to monitor the voltage at the terminals of the standby power supply. If the voltage drops below a predetermined value, coupling for mechanical release is set up. This ensures that it is still possible to open the lock under all circumstances. Establishment of such coupling is advantageously accompanied by an announcement to the user inviting the user to change the standby power source.

It is also advantageous to have motor 44 operate at regular intervals outside of any operating period, for example when opening the door. Such operation avoids any danger of mechanical jamming due to prolonged non-operation of the motor 44. It also makes it possible to detect possible faults in motor 44.

FIG. 6 shows the lock during mechanical release. Manipulating the inner or external operating control causes lever 18 to swing. Because of the presence of the end 48 of the mechanical coupling finger 46 between bearing surface 24 of lever 18 and the second bearing surface 14 of the pawl lifter 6, the swinging of lever 18 causes pawl lifter 6 to rotate and the claw 2 to allow release. The movement of the pawl 8 and the claw 2 is similar to that described above and will not be repeated in detail again. On FIG. 6, arrows 74 and 76 show the rotary movement of the pawl 8 and pawl lifter 6 and claw 2. Arrows 78 and 80 are also provided in FIG. 6, showing the rotation of lever 18 due to the inner or external release control being operated, causing rotation of the pawl 8 and pawl lifter 6.

Mechanical release involves transmitting the force needed to rotate the pawl 8 and pawl lifter 6 from the release control to the lever 18. This force is higher than the force transmitted by the release control to the lever under normal operating conditions illustrated in FIG. 2. This does not prevent low strength parts being used for the control members and lever 18. Mechanical release is only employed under degraded conditions. It is thus acceptable that a larger force is necessary to open the door.

The lock operates as follows. Under normal conditions, the lock is opened as explained with reference to FIGS. 2–4. In this mode of operation, contact of release coupling lever 32 is sufficient to start motor 28 and thereby open the lock.

Locking or unlocking of the lock can be determined by purely software means. Locking can be achieved simply by not starting motor 28, even when the contact of release coupling lever 32 is established. Unlocking is achieved by enabling the motor 28 to start upon the release coupling lever setting up contact.

If a key cylinder is provided, on a forward door for example, it is not essential for the key cylinder to be mechanically linked to the lock. The key cylinder can simply be arranged for the latch to operate a switch, changeover of which sets up or releases locking.

In this simplest embodiment, no distinction is made between locking and security locking. This distinction appears if the second contact 31 is provided at the inside or external release control. The advantage of providing the second contact 31 on the external release control is explained above. In this case, the status of both the first and second contacts 33,31 makes it possible to determine when lever 18 rotates and which of the release controls was actuated. Locking can be provided by only disenabling motor 28 when it is the external release control that is operated, motor 28 being enabled when it is the inside release control that is operated. Security locking in this case involves disenabling motor 28 for both the external and the inside release controls. Release of locking and of security locking are now purely software operations.

Similarly, making a distinction between operation of the inside and external release controls allows a child-proof feature and an override to be provided through software. The child-proof feature consists in disenabling motor 28 when it is just the inside release control that is operated. Override can also be software-controlled.

Under normal operating conditions, the lock of FIG. 1 consequently provides the various release enabling and preventing functions discussed above.

Under degraded operating conditions, the lock operates as shown in FIG. 6, after emergency mechanical release has been brought into action as shown in FIG. 5.

Degraded operation may be necessary for several reasons. A changeover to degraded operation may simply be the result of operation of the inside or external release controls not leading to the lock being released and the door or the like on which the lock is mounted failing to open. In the case of a vehicle door, failure to open can be detected provided the "door open" contact 37 is provided. Switch-over of the first contact 33 at release coupling lever 32 that is not followed by subsequent switch-over of the "door open" contact 37 on the door itself signifies that lever 18 was driven in rotation by an inside or external release control, without the door having opened. In this case, emergency mechanical release can be brought into action so that, at the next attempt, the door will open mechanically. Degraded operation can also be the result of some breakdown in the electrical supply to motor 28, greater force than the motor 28 can supply, or failure of the motor 28 itself. Similarly, switch-over of the first contact 33 of release coupling lever 32 can be used to re-couple mechanical release in the case of electrical failure, when locking is initiated from inside the vehicle by known means (a fascia button for example). Mechanical release can also be enabled in under emergency conditions, detected for example by operation of some safety feature on the vehicle such as an airbag or an ABS system.

Changeover to degraded operation can also result from monitoring the standby power source, as was explained above. This avoids the fact of having locked the door preventing it from being opened in the case of impact or failure of the main power supply of the vehicle.

Unlike a state-of-the-art lock as fitted on the Renault Laguna, the lock described here employs one single coupling system for mechanical release that operates both for the inside release control as well as the external release control. This results from the observation that, in degraded operation, i.e. in an emergency, there is no harm in allowing a door to be opened via the inside or external controls. This observation makes it possible to simplify the means employed for mechanical coupling within the lock.

As the standby motor 44 is only used for establishing coupling for mechanical release, it is not dimensioned for heavy loads. The standby power supply can also be implemented at low cost.

For the user, the reaction to operation of the release control, under normal operating conditions, is insensitive to the reaction of the seals of the door or the like. The force the user exercises on the control is the sum of the force needed to move the control against the biasing action of its spring and the force needed to rotate lever 18. This sum of the forces is independent of the force needed to rotate the pawl lifter 6 and the pawl 8 to release the lock. The force exercised by the user on the inside or external release control can be of the order of 10 N. Under degraded operation, this force is higher, and is not an impediment. The force in this case can be of the order of 80 N.

Figure 7:
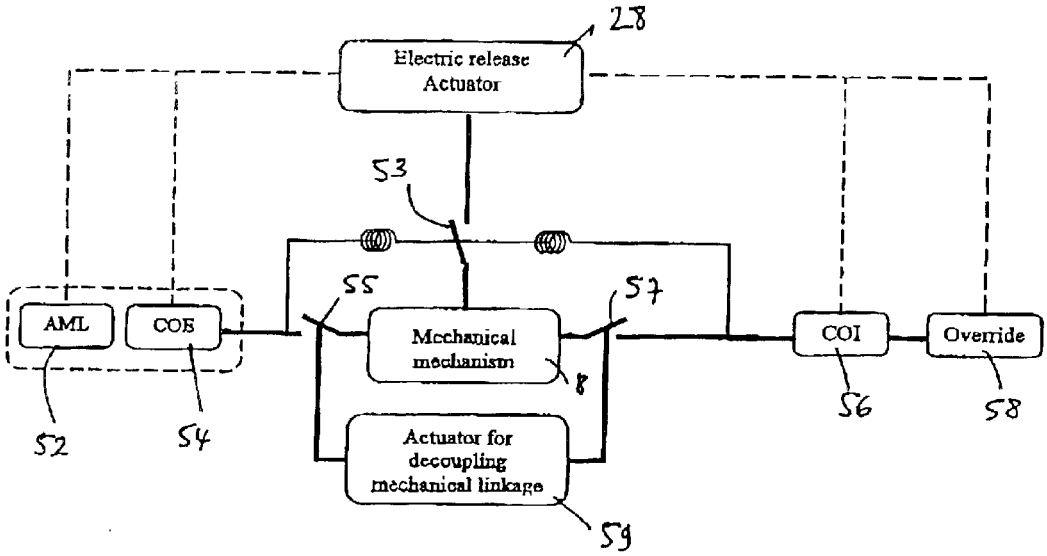
FIG. 7 shows the operation of the lock in FIGS. 1–6.

FIG. 7 is a diagram showing the operation of the lock of FIGS. 1–6. This diagram shows the electric release actuator (motor 28 in the example) as well as the relevant mechanical mechanism of the lock (pawl 8 associated with pawl lifter 6 in the example). The diagram also shows a hands-free sensor 52 which can for example be a key proximity detector. From outside, the lock is designed to be released using the external release control 54. From inside, the lock is designed to be opened via the inside release control, this diagram also showing the override control 58. FIG. 7 shows, in heavy lines, the mechanical linkages between the external release control and the relevant mechanical mechanism, the inside release control and the relevant mechanical mechanism, and the electrical release actuator and the relevant mechanical mechanism.

As discussed above, the mechanical linkages between, firstly, the external release control and the relevant mechanical mechanism and, secondly, between the inside release control and the relevant mechanical mechanism can be selectively enabled or disabled. This is shown symbolically on FIG. 7 by an actuator 59 for decoupling the mechanical linkages. In the example of FIGS. 1–6, this actuator consists of motor 44 with arm 40, and security locking release finger 46. This actuator allows the mechanical linkages to be mechanically enabled or disabled. The mechanical coupling and decoupling is shown symbolically by the switches 55 and 57 on the mechanical connections between, firstly, the external release control and the relevant mechanical mechanism and, secondly, between the inside release control and the relevant mechanical mechanism, as well as by the mechanical linkages between actuator 59 and these switches 55 and 57.

Additionally, as was explained above, the presence of the release coupling lever 32 ensures that the electrical release of the lock can be enabled or disabled mechanically. In other words, when enabled, electric release (enablement of electric motor 28) results in the lock being released. When disabled, enablement of the motor 28 has no effect on release of the lock. Structurally, the release coupling lever 32 ensures coupling or decoupling of motor 28. This is shown in the diagram by a switch 53 between the motor 28 and the relevant mechanical mechanism of the lock. The diagram also shows, in fine lines, that operation of the external or inside release control has the effect of coupling-in electric release of the lock. In the rest state, electric release is always disabled. Further, springs shown symbolically in the diagram indicate a yielding safety feature should motor 28 jam. Mechanical release is still possible even if the motor 28 jams. The dashed lines in the diagram represent software control. Lock release from inside is controlled by software upon manipulation of the external release control, which has the effect of shifting the release coupling lever 32, enabling release, and enable electric release of the lock when the sensors detect opening is desired. The fact that opening is desired can result from manipulation of the external release control as explained above. Additionally, as shown in the diagram, redundancy via sensor 52 can also be provided. Locking of the lock from outside can be controlled from sensor 52.

Lock release via the inside release control is also software-controlled, upon actuation of the inside release control. The effect of actuation of the inside release control by software control is to shift the release coupling lever 32 so as to enable electric release of the lock when one or more sensors detect that release is desired following operation of the inside release control. As explained above, the child-proof feature is implemented by software, by preventing release despite actuation of this feature. The override function is also implemented by software.

In the lock of FIGS. 1–6, the release coupling lever 32 is not indispensable. Its function, as explained above, is to ensure protection against accidental release should the motor 28 operate unintentionally, allowing the mechanical controls for the lock to continue to be used when the motor 28 has jammed in the open position of the lock. Nevertheless, one could dispense with these functions, and not provide the release coupling lever 32.

In the closed position of the lock, and where locking has been released, the mechanical coupling of the lock is disabled. In other words, the mechanical linkages between the inside release control and pawl 8 along with the mechanical linkages between the external release control and the pawl 8 are inoperative. The mechanical linkages participate in the locking operation, since it is necessary to decouple them or withdraw them in order to ensure locking, preventing mechanical release of the lock. However, it is not these mechanical linkages that perform release of security locking, because the mechanical linkages are not enabled even when security locking is not in operation. The advantages of these characteristics are discussed above. The lock is a purely electric lock and not one in which release is assisted electrically. This feature avoids travel of the controls initiating electrical release followed by mechanical release at the end of travel. Even if the user were to operate the inside or external release controls brutally, reaching an end of travel position, the mechanical coupling cannot interfere with operation of the motor 28.

Another problem with state-of-the-art locks is that of diversity. Locks on the left and right hand doors are generally symmetric, in view of the spatial constraints on the position of the lock in the door and the corresponding engaging means on the vehicle. Further, the child-proof feature is frequently only provided on the rear doors, while a key cylinder is only provided on the front doors. Finally, in state-of-the-art electromechanical or mechanical locks, the mechanical linkages between the lock and the external and inside release controls are adapted to each model of door. Thus, current practice is for the same vehicle to carry four models of lock for vehicles of a given range. It may be necessary to provide a lock module model comprising the lock and mechanical linkages to the inside or external release controls and if appropriate the handles or the like themselves for each door of each vehicle. This diversity of models complicates manufacture and is a source of additional costs.

The lock described here produces a solution to this problem of diversity. Locks designed according to this invention allow low strength parts to be used for the linkages between the external and inside release controls, of a length greater than the shortest distance between the lock and the control. Thus, it is possible, for a given door, to choose the system of linkages so that the lock module can be adapted to all the vehicles in the range. For this, it is sufficient to dimension the system of linkages so that the module can be mounted on the vehicle when there is the greatest distance between the controls and the lock. This ensures the module can be mounted on all the doors of all the other vehicles in the range. The greater length needed for the system of linkages not being a problem.

Further, it will be understood from the above description that the enabling and disenabling functions can be implemented by software without it being necessary for the lock itself to have particular mechanical elements, notably for the child-proof feature and the override. Similarly, the presence of a key cylinder on a door does not require any particular mechanical part to be present on the lock. Thus, the same lock can be used for the front and rear doors.

This lock allows a module to be provided that can be used on the front and rear doors of one vehicle or different vehicles. If symmetrical locks are required for the left-hand and right-hand doors, two modules are sufficient to equip all vehicles of a range. This lock consequently provides a response to the problem of diversity.

Figure 8:
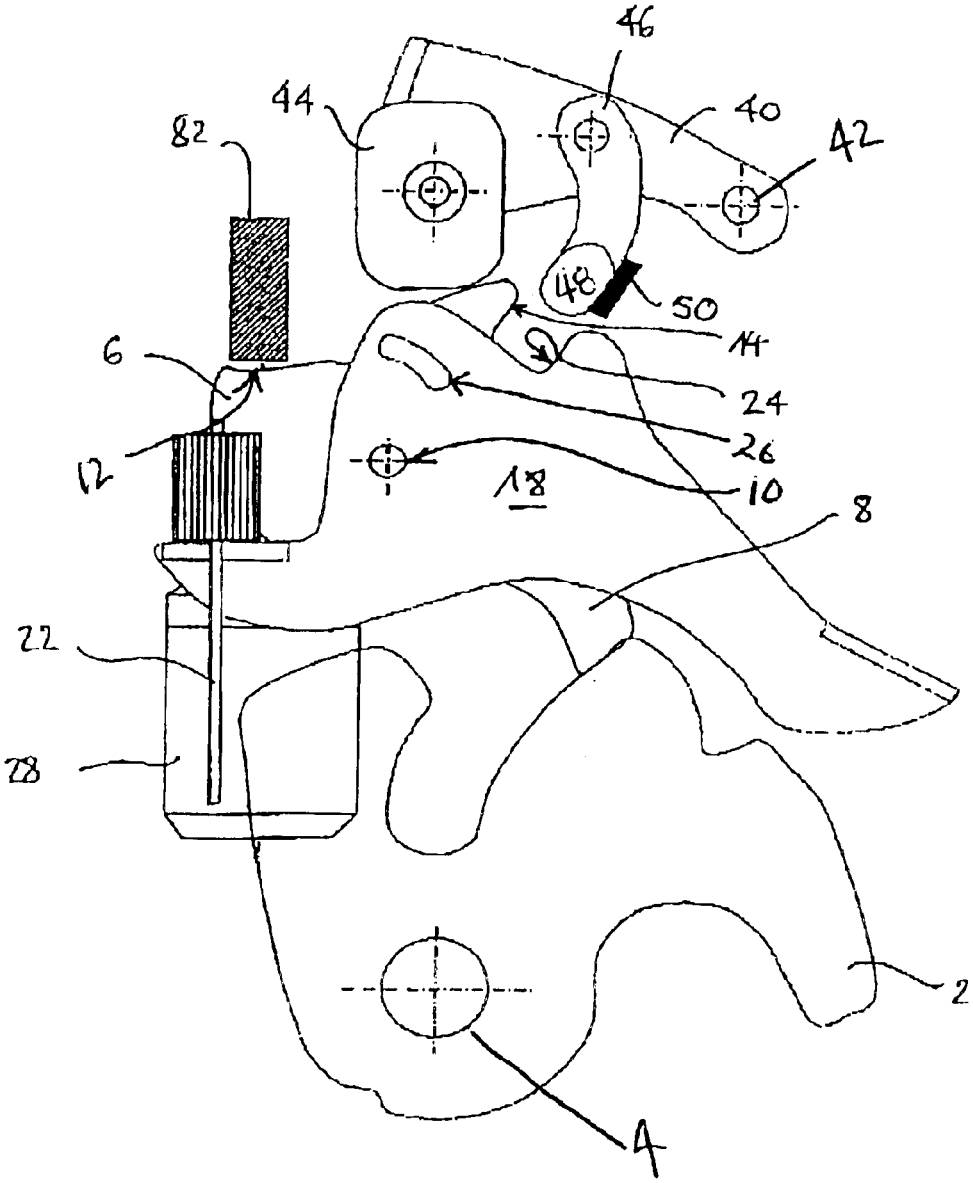
FIG. 8 is a diagrammatic view of a lock according to another embodiment of the invention, in the closed position with security locking in operation.

FIGS. 8–11 show an example of another embodiment of a lock designed according to this invention. The lock illustrated in FIGS. 8–11 is similar to the one illustrated in FIGS. 1–6. However one difference being that instead of only providing one single coupling means for the external and inside release controls, a mechanical linkage is used for the inside release control, and an electrical linkage is provided for the external release control. FIG. 8 is a diagrammatic view of the lock in its closed position with security locking in operation. Those parts of the lock that are similar to those in FIG. 1 are identified by the same reference numerals and will not be described again. One can thus recognize the claw 2, the lever 18, the inside release cable or system of rods 22, the pawl lifter 6, the pawl 8, the electric release motor with its drive arm 40, motor 44, security locking release finger 46, and guide member 50.

Unlike the lock shown in FIG. 1, the lock in FIG. 8 does not include the release coupling lever 32 with the arm 34 and lug 36. Here, drive arm 82 of motor 28 bears directly on the first bearing surface 12 of pawl lifter 6 when motor 28 is operated. The shape of the drive arm 82 of motor 28 differs slightly in FIG. 8 compared to FIG. 1. The absence of the release coupling lever 32 requires that the arm 82 have a dimension in its direction of displacement which is substantially equal to the sum of the dimension of arm 30 and release coupling lever 32. This means it is not necessary to modify the travel of motor 28 to open the lock.

Further, this lock has no external door release cable or rod system 20. Structurally, lever 18 is identical to the one in FIGS. 1–6, but it will be understood that the opening as well as the part designed to receive the external operating cable can be dispensed with.

In the state shown in FIG. 8, the lock is closed and security locking or the child-proof feature is in operation. Like in FIG. 1, security locking release finger 46 is raised and is not located between the bearing surfaces 14 and 24 of lever 18 and pawl lifter 6.

Figure 9:
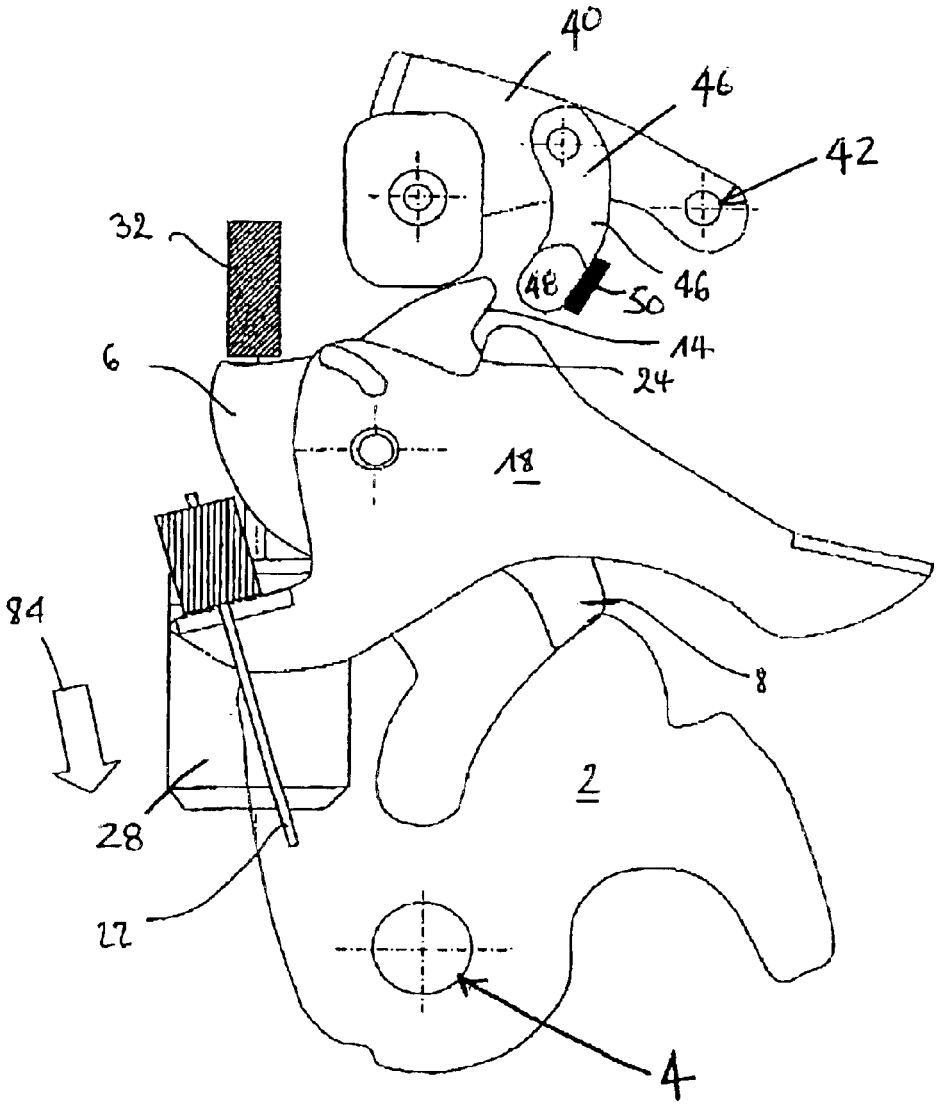
FIG. 9 shows the lock of FIG. 8, showing how the various parts of the lock move when there is an attempt to open it using the inside release control.

FIG. 9 shows, for this situation of the lock, how the parts of the lock move when an attempt is made to open it using the inside release control. The lever 18 is driven to rotate about axis 10 by a pulling force from cable 22, as shown in the diagram by arrow 84. Bearing surface 24 of the lever 18 approaches the second bearing surface 14 of pawl lifter 6. In view of the position of security locking release finger 46, rotation of lever 18 is not transmitted to the pawl lifter 6. Operation on the inside release control consequently does not lead to mechanical release of the lock, as the lock is disabled. When security locking or the child-proof feature is in operation, electric release of the lock is not effective either. This means that an attempt to open the door from the inside release control does not cause release of the lock.

Figure 10:
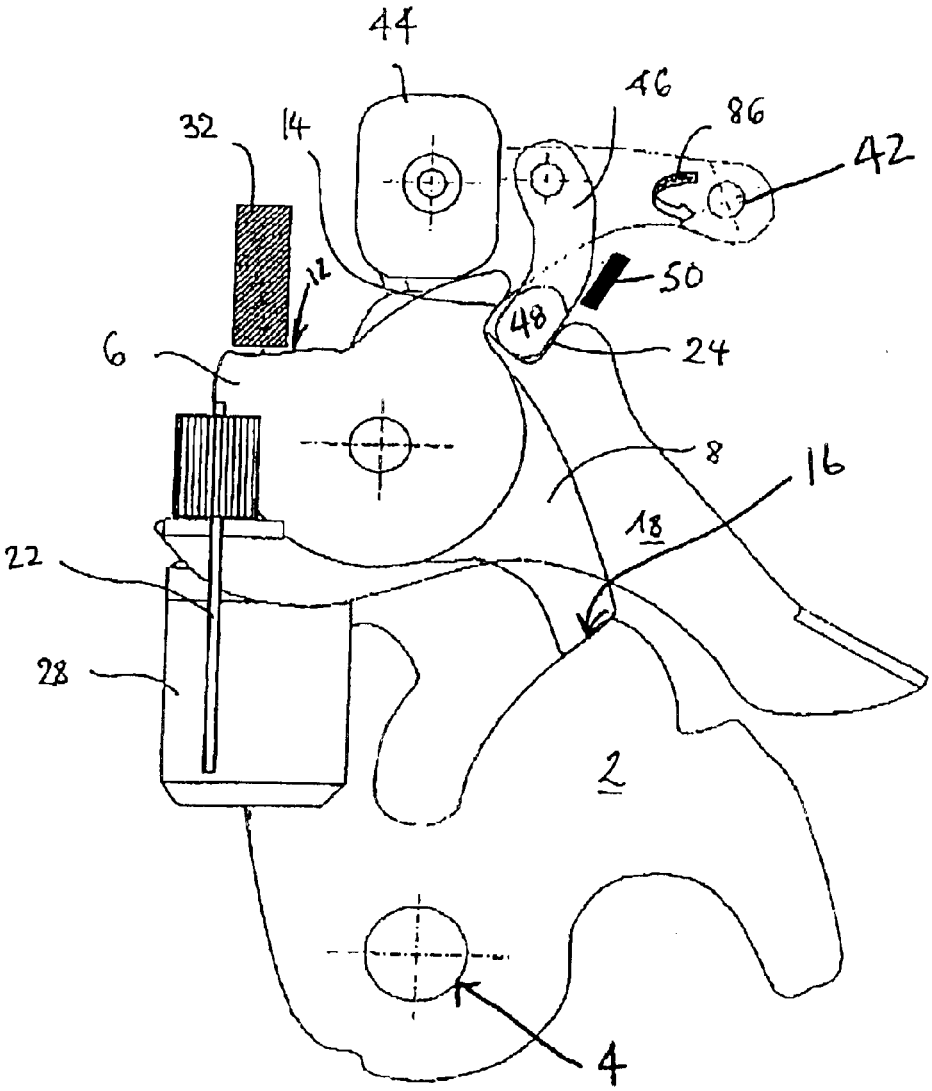
FIG. 10 shows the lock of FIG. 8, in a closed position with security locking operative.

FIG. 10 shows the lock of FIG. 8 in a closed position with security locking not in operation; the claw 2 is in the same position as in FIG. 8. Security locking release finger 46 is in the lower position with its end 48 between the bearing surfaces 14 and 24. The security locked position (child-proof feature activated) of FIG. 8 is replaced by the position shown in FIG. 10 by shifting arm 40 using motor 44, as shown symbolically on FIG. 10 by arrow 86.

Figure 11:
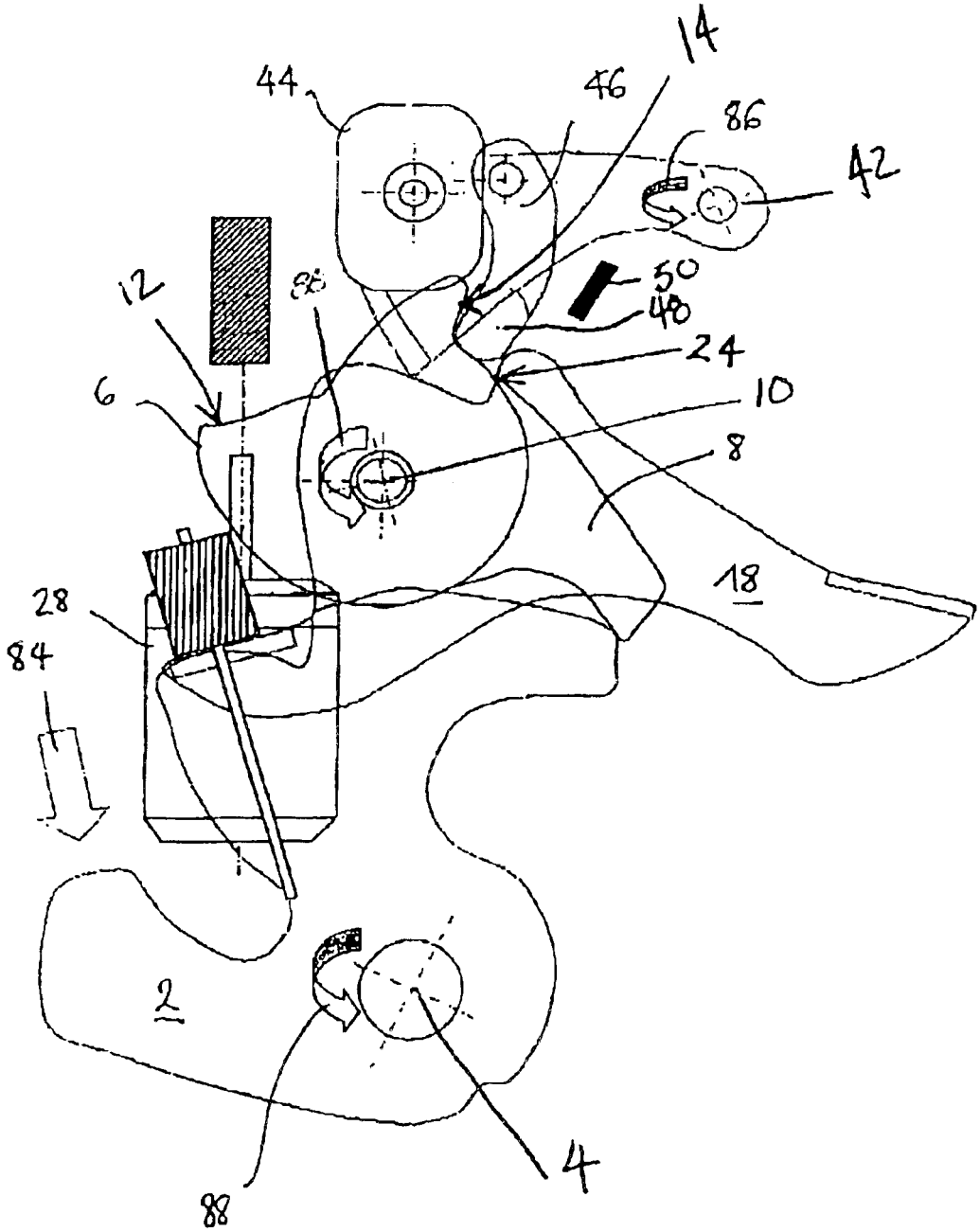
FIG. 11 shows the lock of FIG. 8, showing how the various parts move during mechanical release using the inside mechanical control.

FIG. 11 shows this lock and illustrates how the various parts move upon mechanical release from the inner release control, starting from the state shown in FIG. 10. In FIG. 11, the contour of all parts has been shown for greater clarity. Operating the inside release control causes lever 18 to rotate counter-clockwise as shown symbolically by arrow 88. Bearing surface 24 of lever 18 acts on the end 48 of security locking release finger 46 and the latter acts on the second bearing surface of pawl lifter 6. The result is that pawl lifter 6 and pawl 8 turn counter-clockwise about axis 10. Rotation of the pawl lifter 6 and pawl 8 is shown symbolically by arrow 88. Rotation of the pawl 8 and pawl lifter 6 lead to rotation of the claw 2 about axis 4, shown symbolically on FIG. 11 by arrow 88. Purely mechanical release is involved, motor 28 not being activated.

Figure 12:
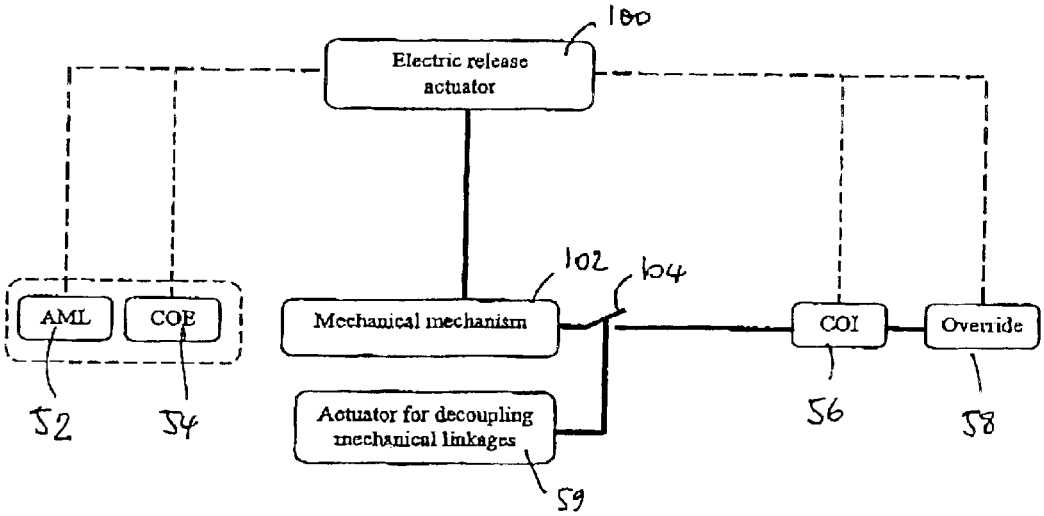
FIG. 12 is a diagram showing the operation of the lock in FIGS. 8 to 11.

FIG. 12 is a diagram showing the operation of the lock in FIGS. 8 to 11 using as an example electric release brought about by operation of the inside release control. In FIG. 12, one can see the electric release actuator 100 (motor 28 and its arm 82 in the example) as well as the mechanical mechanism 102 of the lock (pawl 8 associated with pawl lifter 6 in the example). FIG. 12 again shows the sensor 52, the external release control 54, inside release control 56, override control 58 and actuator 59 for releasing the mechanical mechanism.

In FIG. 12, the mechanical linkages are shown in heavy lines between the electric release actuator 100 and mechanical mechanism 102 and the inside release control 56 and the mechanical mechanism 102.

As was explained above, the mechanical linkages between the inside release control and the mechanical mechanism are designed to be selectively enabled in and disabled. This is shown symbolically in FIG. 12 by the actuator 59 for decoupling the mechanical linkages and by the switch 104. In the example of FIGS. 8 to 11, this actuator consists of motor 44 with arm 40 and security locking release finger 46. This actuator allows mechanical release of the lock to be disabled or enabled in mechanically.

The dashed lines in FIG. 12 show the respective software controls between the sensor 52 and electric release actuator 100, the external release control 24 and electric release actuator 100, the inside release control 56 and electric release actuator 100, and the override control 28 and electric release actuator 100.

The lock operates as follows. Opening the lock via the external release control 24 is done electrically and is achieved by powering motor 28 so that drive arm 22 causes pawl lifter 6 to rotate. There is no cable or rod mechanism going towards the lever 18. In this way, it is not necessary to provide an external release control or lock on the vehicle door. If appropriate, redundancy can apply to the power supply, the sensor or the software to ensure fail-safe release of the lock and using an external remote control. Locking and security locking of this lock are purely software operations, no mechanical parts being involved. The danger of accidental release of the lock is not managed, like in the example of FIGS. 1–6, via electric release that can be enabled or disabled. A sensor can be provided in the external release control, for detecting operation of the external release control (if it exists). Electric release is software-controlled when sensor 52 and the sensor for external release control indicate together that there is a request to open the lock. One can also provide an external watchdog or monitoring means on the lock release electronics to limit the risk of accidental release. FIG. 12 consequently shows a broken line between, sensor 52 and actuator 100 and, between external release control 24 and actuator 100. In the example of FIG. 12, redundancy is implemented between an external release control and a hands-free operation detector. Other sensors could also be used. As regards external lock release, the position of security locking release finger 46 is also immaterial.

Release of the lock from the inside is a mechanical operation. In the locked state, security locked state or with the child-proof feature activated, security locking release finger 46 is in the raised position of FIG. 8. Operation of the inside release control shifts lever 18, but has no effect on the pawl 8 or pawl lifter 6. In FIG. 12, these states correspond to opening of switch 104 by the decoupling actuator 59, whereby mechanical release from the inside release control is disabled. When the security locking has deactivated, in the absence of the child-proof feature, security locking release finger 46 is in the lower position of FIG. 10. In FIG. 12, this corresponds to switch 104 closing thereby establishing coupling for mechanical release of the lock. Operation of the inside release control 56 acts on the mechanical mechanism 102 to release the lock.

The fact of lowering the security locking release finger 46, as shown in FIG. 10, releases the security locking or deactivates the child-proof feature. When the security locking release finger 46 is lowered, operating the inside release control leads to the lock opening, as explained with reference to FIG. 11. The lock is now one with purely electrical release from outside, with inside release being purely mechanical, with mechanical links that can be disabled for providing security locking or activating the child-proof feature.

Locking of the lock is a software operation, as is release of locking. Security locking of the lock is obtained by raising security locking release finger 46, exactly like the child-proof feature. These functions are consequently provided by decoupling mechanical release from inside. Override is a software operation, which does not involve shifting security locking release finger 46.

Like in the example of FIGS. 1–6, the lock of FIGS. 8 to 11 is a solution to reducing the problem of diversity, and that of limiting the requirements for a standby power source in the door. The lock of FIGS. 8 to 11 also makes it possible to simplify door structure, as there are no mechanical linkages involved between the outside release control and the lock. Also, by using sensors other than the sensor for external release control described in the example, external release control members could be completely dispensed with.

It is advantageous, in the case of the lock in FIG. 8, for security locking release finger 46 to be located between the bearing surfaces 14 and 24 in the rest position. This avoids the need to provide a standby power supply in the door for motor 44. Indeed, if security locking release finger 46 is in the upper position in its rest state, it is preferable to provide a standby power source such as a battery or capacitor or the like in the door of the vehicle able to provide, in the case of accident, coupling-in of the mechanical linkages. Conversely, if security locking release finger 46 is in the rest state in its lowered position, it is possible to implement security locking of the lock or a child-proof feature as soon as the vehicle starts, without providing a standby power source. It is sufficient to raise security locking release finger 46 using the vehicle battery. If security locking release finger 46 is always left in the lower position on the driver's door. In other words, if security locking of the driver's door is not allowed, there always remains one door able to be opened via the inside release control, even in the case of accident.

Alternatively to what was described with reference to FIG. 9, one could provide, in the example of FIGS. 1–6, electrical release via motor 28, which is initiated by movement of the inside release control or movement of the lever 18. In this case, the effect of operating the inside release control shown in FIG. 9 would be to initiate electrical release. This solution provides electrical release of the lock from the inside release control. It has the disadvantage of requiring the presence of a standby power source for lowering security locking release finger 46 in the case of failure of electrical release, to allow the lock to be opened mechanically at least via the inside release control.

Another alternative is to provide electrically-assisted release from the inside release control. In this case, when locking is released in the absence of security locking or the child-proof feature, security locking release finger 46 is in a lower position as shown in FIG. 10. Operating the inside release control shifts the lever 18 and initiates release via the motor 28. This solution has the disadvantage of mechanically-assisted release, in particular the risks accompanying brutal operation of the inside release control. It also avoids the need to provide a standby power source in the door and allows only a very low-powered motor 44 to be used for operating security locking release finger 46.

Obviously, the invention is not limited to the embodiments described by way of example. In particular, the shape of the various parts providing electrical or mechanical release of the lock such as the pawl 8 and pawl lifter 6, the lever 18, etc can vary. The lever 18 could thus be a part that moves in translation although such a part that moves in translation is not covered by a strict definition of the word "lever". The springs that provide biasing of the various parts of the lock to a certain position have been mentioned, it would also be within the contemplation of this invention to provide electrical closing of the lock. It is particularly advantageous to only provide one single coupling system for the external and inside release controls, however separate linkages for each control could nevertheless be provided. The examples mention electric motors for the electric release of the lock or the enablement of mechanical release, however other actuators such as pneumatic actuators may also be used.

We have described a configuration with three switches providing the various functions of enabling and disenabling release of the lock. It is advantageous for the standby circuit controlling operation of standby motor 44 to be connected not only to the standby power source, to the standby motor 44 and to the main circuit of the vehicle, but also to these three switches. Thus, mechanical release can be enabled upon detection of a degraded situation by the main circuit of the vehicle, with a command being sent to the circuit for controlling the standby motor 44. Mechanical release can also be enabled in upon autonomous detection by the standby circuit, from the three switches. For example, should motor 28 fail, the standby circuit can initiate coupling-in of mechanical release of the lock, even if the main power supply of the vehicle is unaffected.

The various circuits or software for controlling the lock have not been described in detail. The various circuits can be implemented by those skilled in the art using components known in this technical field.

What is claimed is:

1. A lock assembly for a door comprising:

a locking member movable between a locked position and a released position;

a pawl for holding said locking member in said locked position and movable to release said locking member;

an actuator activated from outside the door for moving said pawl and releasing said locking member;

a coupling mechanism including a coupling arm, said coupling arm movable between an enabled and a disabled position;

a lever operable from inside the door for moving said pawl to release said locking member when said coupling arm is in said enabled position, where said enabled position comprises said coupling arm disposed within a space defined between said pawl and said lever, said lever inoperable for moving said pawl when said coupling arm is in said disabled positions; and a coupling release lever attached in said lever and movable into a position between said actuator and said pawl for forming a mechanical transmission path between said actuator and said pawl.

2. The assembly of claim 1, wherein said coupling arm forms a portion of a mechanical transmission path between said lever and said pawl when in said enabled position.

3. The assembly of claim 2, wherein said coupling mechanism includes a standby actuator for moving said coupling arm between said enabled and disabled positions.

4. The assembly of claim 3, wherein said standby actuator is an electric motor.

5. The assembly of claim 4, wherein said electric motor is of an electric power less than or equal to 10 Watts.

6. A lock assembly for a door comprising:

a locking member movable between a locked position and a released position;

an actuator activated from outside the door for releasing said locking member;

a coupling mechanism movable between an enabled and a disabled position;

a lever operable from inside the door for releasing said locking member when said coupling mechanism is in said enabled position, said lever inoperable for releasing said locking member when said coupling mechanism is in said disabled position;

a pawl holding said locking member in said locked position and movable to release said locking member, said pawl movable in response to both said actuator and said lever; and a coupling release lever attached to said lever and movable into a position between said actuator and said pawl for forming a mechanical transmission path between said actuator and said pawl, wherein said coupling release lever activates said actuator when in said position between said actuator and said pawl.

7. The assembly of claim 1, including an actuator arm driven by said actuator to engage said coupling release lever.

8. The assembly of claim 1, wherein said actuator is an electric motor.

9. The assembly of claim 8, wherein said electric motor is of an electric power less than 100 Watts.

10. The assembly of claim 8, wherein said electric motor is of an electric power less than 80 Watts.

11. A module for a door comprising:

a lock having a locking member movable between a locked position and a released position;

a pawl for holding said locking member in said locked position and movable to release said locking member;

an actuator activated from outside the door for moving said pawl and releasing said locking member;

a coupling mechanism including a coupling arm, said coupling arm movable between an enabled and disabled position;

a lever operable from inside the door for moving said pawl to release said locking member when said coupling arm is in said enabled position, wherein said enabled position comprises said coupling arm disposed within a space defined between said pawl and said lever, said lever inoperable for moving said pawl when said coupling arm is in said disabled position; and a coupling release lever attached to said lever and movable into a position between said actuator and said pawl for forming a mechanical transmission path between said actuator and said pawl.

12. The module of claim 11, wherein said coupling arm forms a portion of a mechanical transmission path between said lever and said pawl when in said enabled position.

13. The module of claim 12, wherein said coupling mechanism includes a standby actuator for moving said coupling arm between said enabled and disabled positions.

14. A module for a door comprising:

a lock having a locking member movable between a locked position and a released position;

an actuator activated from outside the door for releasing said locking member;

a coupling mechanism movable between an enabled and a disabled position;

a lever operable from inside the door for releasing said locking member when said coupling mechanism is in said enabled position, said lever inoperable for releasing said locking member when said coupling mechanism is in said disabled position; and a coupling release lever attached to said lever and movable into a position between said actuator and said pawl for forming a mechanical transmission path between said actuator and said pawl wherein said coupling release lever activates said actuator when in said position between said actuator and said pawl.

15. The module of claim 13, including an actuator arm driven by said actuator to engage said coupling release lever.

* * * * *